US007101215B2

(12) United States Patent
Woellner et al.

(10) Patent No.: US 7,101,215 B2
(45) Date of Patent: Sep. 5, 2006

(54) CABLE PLUG RETENTION CLIP

(75) Inventors: Douglas R. Woellner, Houston, TX (US); David P. Eichberger, Houston, TX (US); Tom S. Sparks, Katy, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/814,840

(22) Filed: Mar. 31, 2004

(65) Prior Publication Data

US 2005/0221629 A1 Oct. 6, 2005

(51) Int. Cl.
*H01R 13/62* (2006.01)

(52) U.S. Cl. ..... 439/371

(58) Field of Classification Search ..... 439/368–373, 439/367

See application file for complete search history.

(56) References Cited

U.S. PATENT DOCUMENTS 3,017,598 A * 1/1962 Low ..... 439/366
3,601,757 A 8/1971 Gober
4,099,819 A * 7/1978 Keglewitsch ..... 439/371
4,400,051 A 8/1983 Stenz
4,407,554 A 10/1983 Drall
4,451,102 A 5/1984 Reh
4,564,255 A 1/1986 Kirma
4,652,069 A 3/1987 Smith
4,662,697 A 5/1987 Moses
4,702,709 A 10/1987 Santilli
4,733,234 A 3/1988 Sparks et al.
4,917,625 A * 4/1990 Haile ..... 439/358
4,934,919 A * 6/1990 Matsushita et al. ..... 425/405.2
5,011,427 A * 4/1991 Martin ..... 439/373
5,087,210 A 2/1992 Myers et al.
5,133,671 A 7/1992 Boghosian
5,151,033 A 9/1992 Kawai et al.
5,151,035 A 9/1992 Kawai et al.
5,171,291 A 12/1992 d'Arc et al.
5,277,620 A * 1/1994 Taylor ..... 439/490
5,336,107 A 8/1994 Sheryll
5,348,495 A * 9/1994 Kasden ..... 439/371
D353,578 S 12/1994 Johnson et al.
5,454,729 A * 10/1995 Wen-Te ..... 439/357
5,488,208 A * 1/1996 Seewald ..... 200/43.22
5,593,313 A * 1/1997 Shibuya et al. ..... 439/373
5,655,924 A * 8/1997 Cross et al. ..... 439/373
5,725,393 A 3/1998 Steininger et al.
5,785,547 A 7/1998 Cross et al.
5,906,520 A 5/1999 Frinker et al.
5,928,023 A * 7/1999 Buckner et al. ..... 439/373
5,934,919 A 8/1999 Cross et al.
D428,598 S 7/2000 Carter-Williams et al.
6,086,432 A 7/2000 Frinker et al.
6,095,846 A 8/2000 Becerra
6,135,778 A 10/2000 Ubelein
6,196,859 B1 3/2001 Garlarza
6,260,981 B1 * 7/2001 Fiene ..... 362/147
6,329,597 B1 12/2001 Kaloustian (Continued)

*Primary Examiner*—Truc Nguyen

(57) ABSTRACT

A cable plug retention clip having a clip body adapted to secure a cable plug to a power distribution unit. The clip body has a first retention mechanism adapted to secure the clip body to the power distribution unit, and a second retention mechanism adapted to secure the clip body to the cable plug. A system having a power strip comprising a power outlet adapted to receive a plug of a power cord, and a plug retainer adapted to couple the plug to the power strip. The plug retainer has a first retention mechanism engageable with the power strip, and a second retention mechanism engageable with the plug.

33 Claims, 4 Drawing Sheets

U.S. PATENT DOCUMENTS

| | | | |
|---|---|---|---|
| 6,491,539 | B1 | 12/2002 | Johnston |
| D475,352 | S | 6/2003 | Longanecker |
| 6,756,543 | B1 | 6/2004 | Kaloustian |
| 2004/0108126 | A1 | 6/2004 | Kaloustian |
| 2004/0127107 | A1 | 7/2004 | Lischeck et al. |

* cited by examiner

CABLE PLUG RETENTION CLIP

BACKGROUND OF THE RELATED ART

This section is intended to introduce the reader to various aspects of art, which may be related to various aspects of the present technique that are described and/or claimed below. This discussion is believed to be helpful in providing the reader with background information to facilitate a better understanding of the various aspects of the present invention. Accordingly, it should be understood that these statements are to be read in this light, and not as admissions of prior art.

Power distribution units, such as power strips, are often utilized to power electronic devices, such as desktop computers, servers, and rack systems. These power distribution units generally have one or more power outlets, which are coupleable with plugs of power cords of the various electronic devices. Unfortunately, these plugs are not securely coupled to the power outlets. Thus, minor movements can cause disconnection of the plugs from the power distribution unit.

SUMMARY

A cable retention clip having a clip body adapted to secure a cable plug to a power distribution unit. The clip body has a first retention mechanism adapted to secure the clip body to the power distribution unit, and a second retention mechanism adapted to secure the clip body to the cable plug. A system having a power strip comprising a power outlet adapted to receive a plug of a power cord, and a plug retainer adapted to couple the plug to the power strip. The plug retainer has a first retention mechanism engageable with the power strip, and a second retention mechanism engageable with the plug.

BRIEF DESCRIPTION OF THE DRAWINGS

Advantages of one or more disclosed embodiments may become apparent upon reading the following detailed description and upon reference to the drawings in which.

DETAILED DESCRIPTION

One or more specific embodiments of the present technique will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
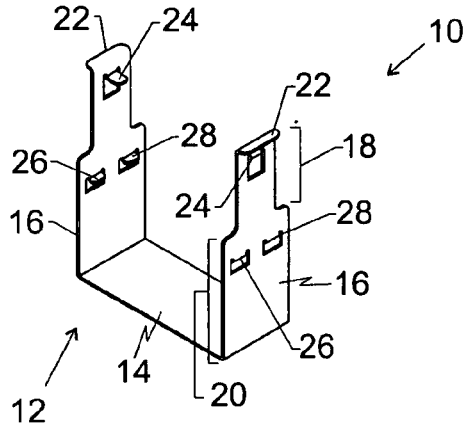
FIG. 1 is a perspective view of a cable retention clip in accordance with embodiments of the present invention.

Turning now to the figures, FIG. 1 illustrates a cable retention clip 10 adapted to secure a plug to a power distribution unit (e.g., a power strip). The illustrated cable retention clip 10 comprises a U-shaped frame 12 having a base 14 and opposite sidewalls 16. As illustrated, the opposite sidewalls 16 are generally parallel with one another. However, certain embodiments of the cable retention clip 10 may angle the opposite sidewalls 16 inwardly toward one another, thereby creating a compressive force between the opposite sidewalls 16 if positioned in a parallel configuration. Each sidewall 16 comprises an upper portion 18 and a lower portion 20. Each of the upper portions 18 comprises an outwardly projecting rim or lip 22, which is user grippable to facilitate inward and outward biasing of the opposite sidewalls 16 with respect to one another. In addition, an optional retention wrap may be extended around the cable retention clip 10 at the lips 22 to bias the opposite sidewalls 16 inwardly toward one another.

The illustrated cable retention clip 10 also comprises a variety of securement mechanisms to maintain a relatively tight coupling of the power cable connector or plug with the power distribution unit. Accordingly, each of the upper portions 18 has an inwardly extending member or upper tooth or lug 24, and each of the lower portions has a pair of inwardly extending grips or lower teeth 26 and 28. As discussed in further detail below, the upper teeth 24 are securable with the power cable connector or plug, while the lower teeth 26 and 28 are securable with the power distribution unit. Together, the teeth 24, 26, and 28 and the U-shaped frame 12 of the cable retention clip 10 retain the power cable connector or plug with the power distribution unit in a relatively tight assembly (e.g., substantially no play), thereby preventing undesirable disconnection and loss of power. In addition, as discussed in further detail below, an optional retention wrap may be extended around the cable retention clip 10 to maintain engagement of the teeth 24, 26, and 28 with the respective power cord connector or plug and the power distribution unit. Advantageously, the optional retention wrap further tightens the assembly of the plug and the power distribution unit. In certain embodiments, the optional retention wrap creates a compressive load between the plug and the power distribution unit, thereby substantially eliminating freedom of movement therebetween.

Figure 2:
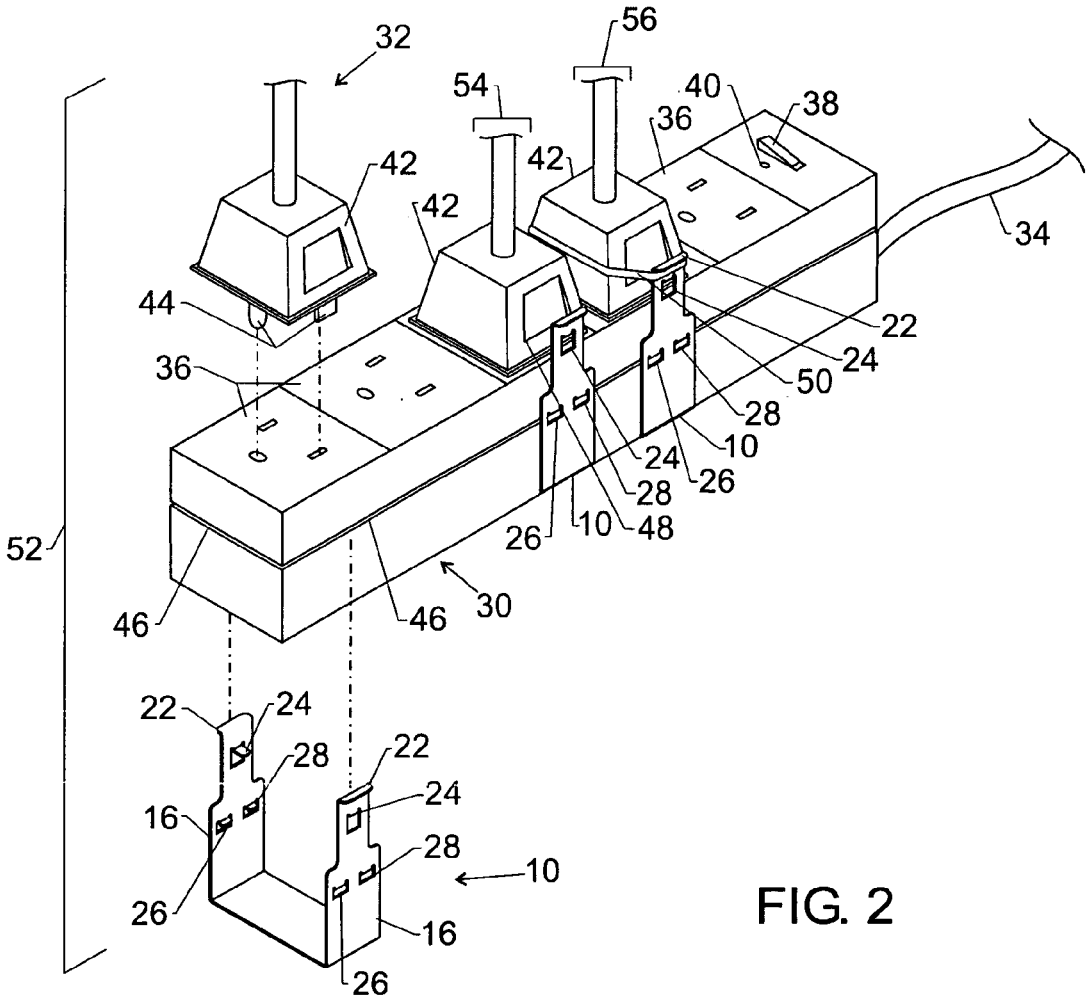
FIG. 2 is a perspective view illustrating an exploded view of a cable retention clip and a retention wrap securing plugs of power cords to a power distribution units in accordance with embodiments of the present invention.

FIG. 2 illustrates a perspective view of a power distribution system in accordance with embodiments of the present invention. As illustrated, the system comprises a power distribution unit or power strip 30 and one of the cable retention clips 10 for each device power cable-plug 32 being coupled to the power distribution unit 30. The illustrated power distribution unit 30 comprises an inlet power cord 34, an outlet power connector or receptacle 36, a power on/off switch 38, and a indicator light 40. The indicator light 40 may provide a variety of status indicators, such as a power on/off status or a surge protection active/inactive status. The power distribution unit 30 also may comprise a surge protector or other power control circuitry, as recognized by one of ordinary skill in the art. The illustrated power connector or receptacle 36 has a standard three-prong receptacle configuration, which is adapted to receive a either a two-prong or three-prong configuration of connector prongs 44 of a power cable connector or plug 42. However, other embodiments may employ alternative connector configurations as recognized by those of ordinary skill in the art. In addition, the power distribution unit 30 comprises a retention structure or tooth slot 46 (extending around the outer wall of the body of the power distribution unit 30) and the plug 42 comprises a retention structure or tooth lip 48. As discussed in further detail below, the lower teeth 26 and 28 and the upper teeth 24 of the cable retention clip 10 are securable with the tooth slot 46 and the tooth lip 48, respectively, to secure the plug 42 with the power distribution unit 30. Again, the securement of these teeth 24, 26, and 28 with lip 48 and slot 46 retains the plug 42 and the power distribution unit 30 in a relatively tight assembly (e.g., substantially no play).

Turning now to the operation of the cable retention clips 10, FIG. 2 illustrates three stages or configurations 52, 54, and 56 of the cable retention clip 10 being used to secure the plug 42 to the power distribution unit 30. In the first stage or configuration 52, the cable retention clip 10 and the plug 42 are both exploded from the power distribution unit 30. In the second stage or configuration 54, the cable retention clip 10 and the plug 42 are both engaged with the power distribution unit 30. To proceed from stage 52 to stage 54, a user may insert the connector prongs 44 of the plug 42 into the receptacle 36 of the power distribution unit 30, bias the opposite sidewalls 16 of the clip 10 outwardly from one another via the grippable lips 22, move the cable retention clip 10 upwardly and about the power distribution unit 30, and then release the opposite sidewalls 16 to bias resiliently inward against the power distribution unit 30. As the opposite sidewalls 16 engage the power distribution unit 30, the lower teeth 26 and 28 of the cable retention clip 10 engage the tooth slot 46 of the power distribution unit 30, while the upper teeth 24 engage the lip 48 of the plug 42. One or more of these teeth 24, 26, and 28 also may bite into the respective structures of the plug 42 and the power distribution unit 30. As a result, the teeth 24, 26, and 28 secure the plug 42 to the power distribution unit 30 in a relatively tight assembly (e.g., substantially no play). To remove the power cable, a user may bias the opposite sidewalls 16 of the clip 10 outwardly from one another via the grippable lips 22, and then pull the connector prongs 44 of the plug 42 outwardly from the receptacle 36 of the power distribution unit 30.

Referring now to the third stage or configuration 56 illustrated in FIG. 2, a retention wrap 50 may be disposed about the plug 42 and the cable retention clip 10 to further secure the plug 42 to the power distribution unit 30. More specifically, and the retention wrap 50 may be compressed about the plug 42 at the outer lip 22 of the cable retention clip 10, thereby biasing the upper teeth 24 against the lip 48 of the plug 42. As a result, the upper teeth 24 forcibly engage the lip 48, thereby tightening the assembly of the plug 42 and the power distribution unit 30. The retention wrap 50 also prevents the upper teeth 24 from slipping free from the lip 48. In certain embodiments, the upper teeth 24 also may bite into the structure of the plug 42. The illustrated retention wrap 50 may comprise a length of wire, fabric, string, plastic or other material, which is secured in a loop about the plug 42 and clip 10 via a knot, a latching mechanism, a threaded fastener, Velcro or another suitable fastening mechanism. For example, the retention wrap 50 may comprise a conventional plastic tie wrap, which has a female latching end and a male latching end having a plurality of serrated features engageable with the female latching end.

Figure 3:
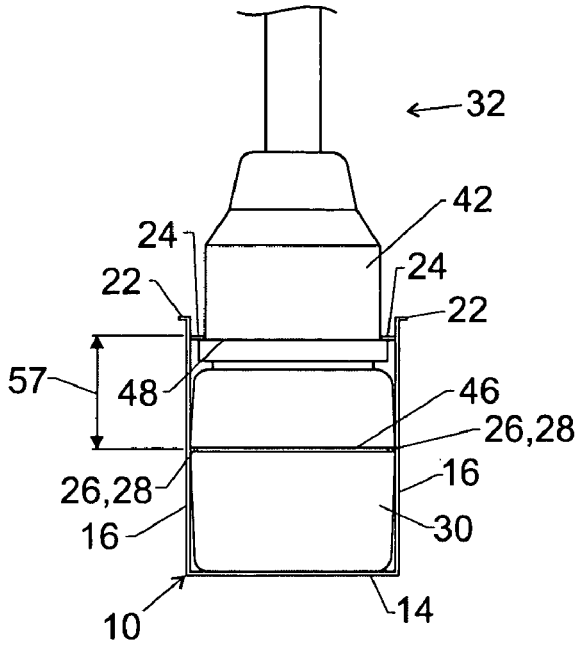
FIG. 3 is a side view of a cable retention clip securing a power cord to a power distribution unit in accordance with embodiments of the present invention.

FIG. 3 is a side view of the plug 42 securely coupled to the power distribution unit 30 via the cable retention clip 10, as discussed above with reference to configuration 54 of FIG. 2. As more clearly illustrated in FIG. 3, the base 14 and opposite sidewalls 16 of the cable retention clip 10 extend around the base and sides of the power distribution unit 30, such that the upper teeth 24 and the lower teeth 26 and 28 are inwardly biased against the plug 42 and the power distribution unit 30, respectively. More specifically, the lower teeth 26 and 28 extend into the tooth slot 46 of the power distribution unit 30, thereby securing the cable retention clip one to the power distribution unit 30. The upper teeth 24 extend over the lip 48 of the plug 42, thereby preventing extraction of the plug 42 from the power distribution unit 30. As illustrated, the upper teeth 24 and lower teeth 26 and 28 are separated by a distance 57, which is substantially equivalent to the separation between the lip 48 and the tooth slot 46. Accordingly, the securement of teeth 24, 26, and 28 with the lip 48 and slot 46 retains the plug 42 with the power distribution unit 30 in a relatively tight assembly, i.e., substantially no play or freedom of movement away from one another. In certain embodiments, the distance 57 may be relatively shorter or longer than the separation between the lip 48 and the tooth slot 46. For example, a shorter distance 57 may be selected to facilitate a compressive load between the plug 42 and the power distribution unit 30. Again, one or more of these teeth 24, 26, and 28 may additionally or alternatively bite into the respective structures of the plug 42 and the power distribution unit 30 to secure the cable retention clip 10.

Figure 4:
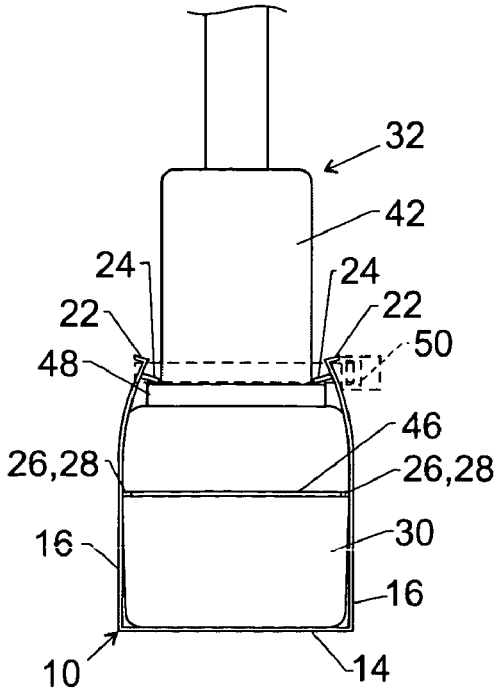
FIG. 4 is a side view of a cable retention clip and a retention wrap securing a power cord to a power distribution unit in accordance with embodiments of the present invention.

FIG. 4 is a side view of the plug 42 securely coupled to the power distribution unit 30 via the cable retention clip 10, as discussed above with reference to configuration 56 of FIG. 2. Similar to the configuration 54 illustrated in FIG. 3, the base 14 and opposite sidewalls 16 of the cable retention clip 10 extend around the base and sides of the power distribution unit 30, such that the upper teeth 24 and the lower teeth 26 and 28 are inwardly biased against the plug 42 and the power distribution unit 30, respectively. However, in the illustrated embodiment of FIG. 4, the retention wrap 50 is disposed about the plug 42 and the cable retention clip 10, thereby biasing the upper teeth 24 of the cable retention clip 10 against the lip 48 of the plug 42. As a result, the retention wrap 50 more securely fastens the cable retention clip 10 to the plug 42, thereby preventing accidental detachment of the cable retention clip 10 and the plug 42. Again, the retention wrap 50 also may create a compressive load between the plug 42 and the power distribution unit 30, thereby substantially eliminating play or freedom of movement therebetween.

Figure 5:
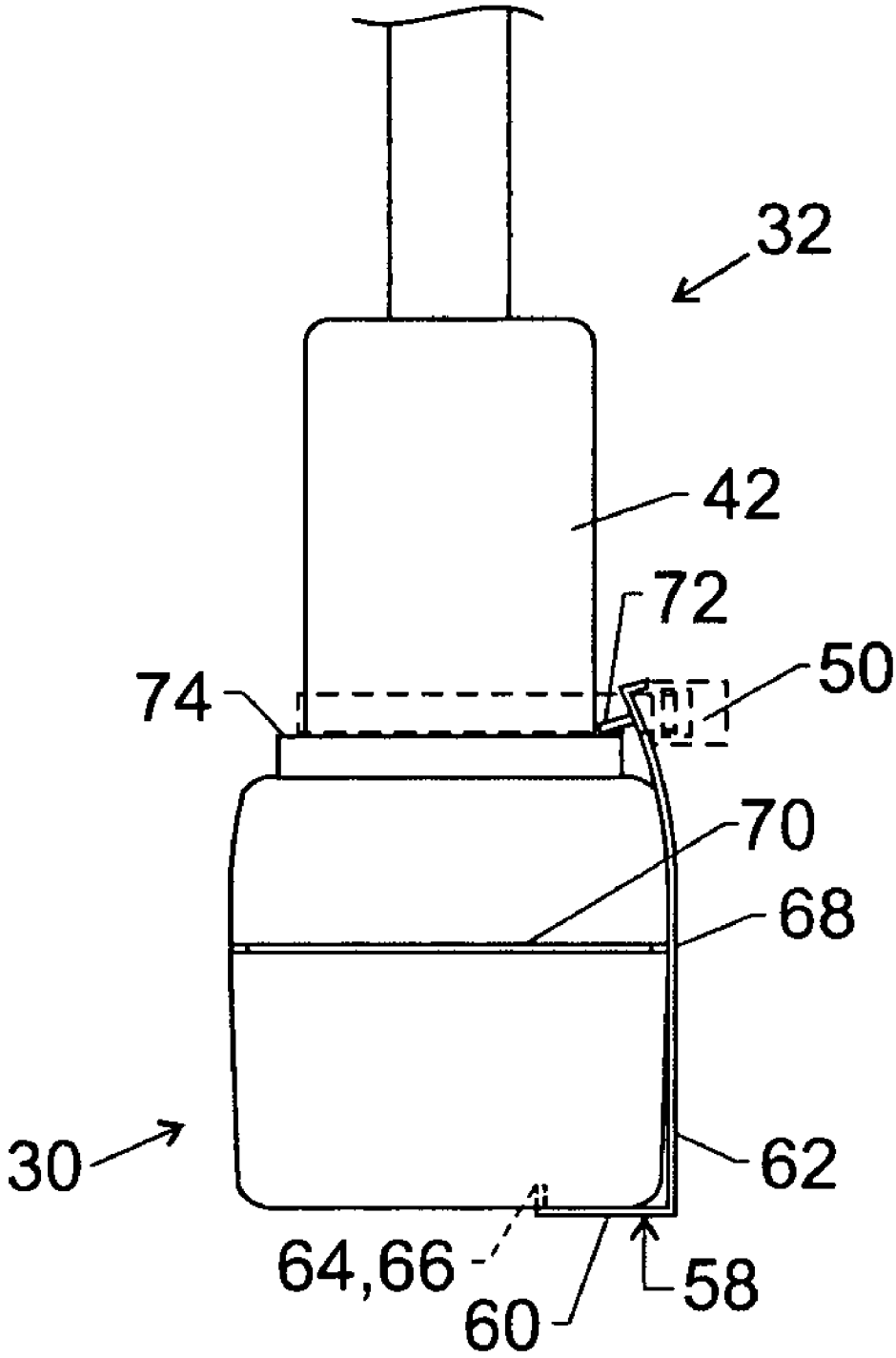
FIG. 5 is a side view of an alternative cable retention clip and retention wrap securing a power cord to a power distribution unit in accordance with embodiments of the present invention.

FIG. 5 is a side view of the plug 42 securely coupled to the power distribution unit 30 via an alternative cable retention clip 58 in accordance with certain embodiments of the present invention. As illustrated, the cable retention clip 58 comprises an L-shaped structure, which has a base 60 and a sidewall 62. At the base 60, the cable retention clip 58 has an inwardly projecting structure or tooth 64, which engages the power distribution unit 30 at a corresponding lip or tooth receptacle 66 in the base of the power distribution unit 30. Along the sidewall 62, the cable retention clip 58 has an inwardly projecting structure or lower tooth 68, which engages the power distribution unit 30 at a corresponding lip or tooth receptacle 70 in the front wall of the power distribution unit 30. In cooperation, the teeth 64 and 68 engage the receptacles 66 and 70 to secure the cable retention clip 58 to the power distribution unit 30. Along the upper portion of the sidewall 62, the cable retention clip 58 also has an inwardly projecting structure or lug or upper tooth 72, which engages the plug 42 at a mating structure or lip 74 to secure the plug 42 to the power distribution unit 30.

As indicated by the dashed lines in FIG. 5, the illustrated embodiment also may optionally have the retention wrap 50 disposed about the plug 42 and the cable retention clip 58. As illustrated, the retention wrap 50 biases the upper tooth 72 of the cable retention clip 58 against the 74 of the plug 42, thereby further securing the plug 42 to the power distribution unit 30. Again, one or more of the teeth 64, 68, and 72 may additionally or alternatively bite into the respective structures of the plug 42 and the power distribution unit 30.

Figure 6:
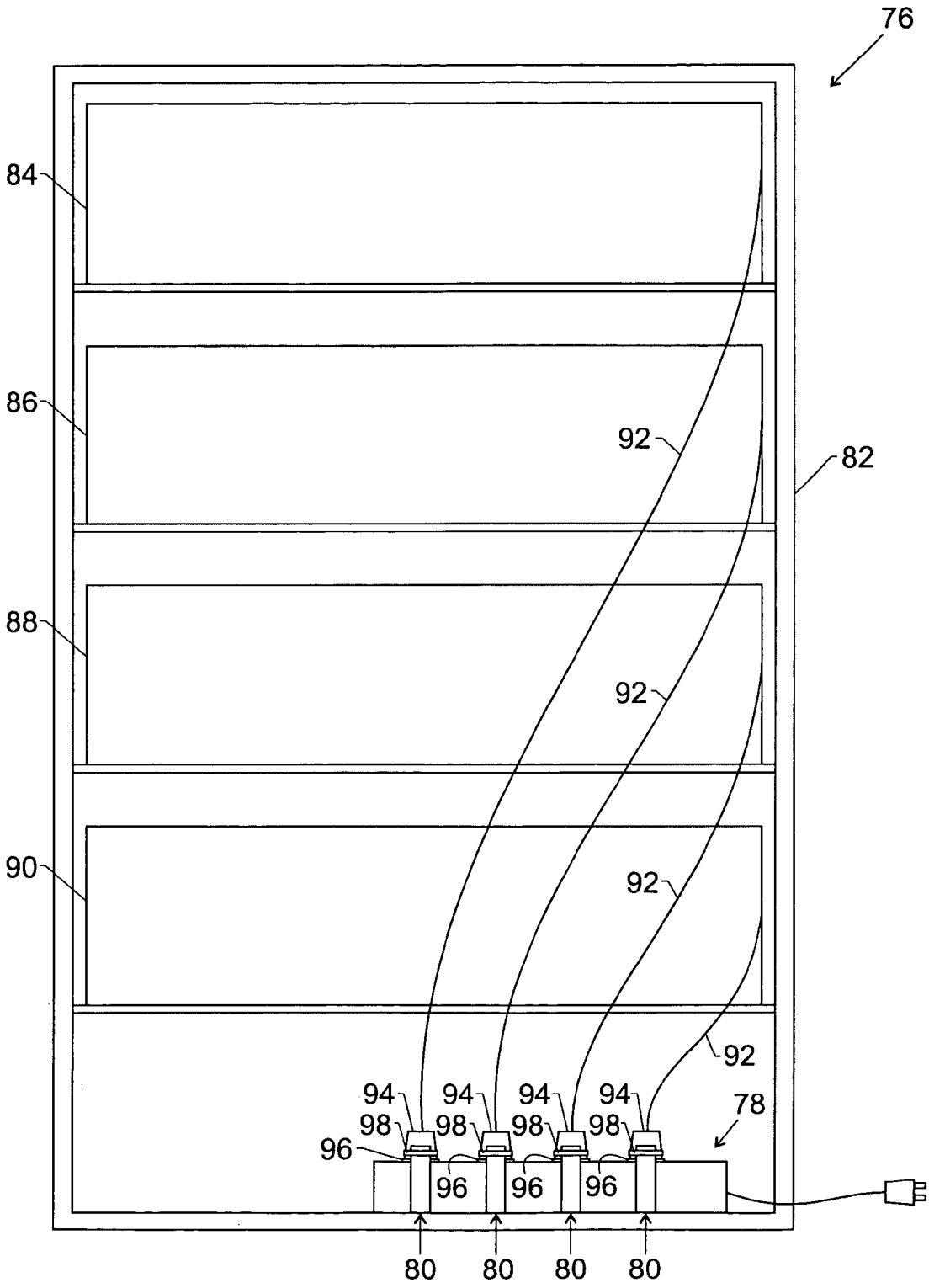
FIG. 6 is a rear view of a system having a cable retainer and a power distribution unit in accordance with embodiments of the present invention.

As recognized by those of ordinary skill in the art, the foregoing retention clips 10 and 58, power distribution unit 30, and plug 42 may be employed in a variety of systems and devices. For example, certain embodiments of the present invention may be incorporated into a rack mount computer system, a desktop computer, a server, and other systems depending on uninterrupted power. FIG. 6 is a rear view of a system 76 having a power distribution unit 78 and cable plug retainers 80 in accordance with embodiments of the present invention. As illustrated, the system 76 comprises a rack structure 82 and rack mounted devices 84, 86, 88, and 90. In certain embodiments, the system 76 may comprise a rack mount computer system, and the rack 94 at the bottom of the components, network devices, and so forth. Each of the rack mounted devices 84, 86, 88 and 90 comprise power cords 92 leading to a connector or plug 94, which is coupled to a mating connector or receptacle 96 of the power distribution unit 78. Advantageously, the cable plug retainers 80 are engaged with each of these plugs 94 to secure the plugs 94 in a tight assembly with the power distribution unit 78. For example, the cable plug retainers 80 may have a U-shaped structure with teeth or lugs engaging both the plugs 94 and the power distribution unit 78, thereby restricting release of the plugs 94 from the power distribution unit 78. Retention wraps 96 also may be disposed about the plugs 94 and the cable plug retainers 80 to secure the cable plug retainers 80 more tightly into engagement with both the plugs 94 and the power distribution unit 78.

In the illustrated embodiment of FIG. 6, the cable plug retainers 80 may comprise either of the cable retention clips 12 and 58 of FIGS. 1–5. In other embodiments, the cable plug retainers 80 may comprise a hinged clip or a Velcro strap. For example, a clip or strap may be wrapped around the power distribution unit 78 and the plugs 84, such that the clip or strap biases the plugs 84 inwardly into the power distribution unit 78. By further example, the cable plug retainers 80 may be an integral or removably secured component of the plugs 94, the power distribution unit 78, or the rack structure 82. In such an embodiment, the cable plug retainers 80 also may automatically wrap around one or both of the plugs 94 and the power distribution unit 78, such that the plugs 94 are automatically secured to the power distribution unit 78.

While the technique may be susceptible to various modifications and alternative forms, specific embodiments have been shown by way of example in the drawings and will be described in detail herein. However, it should be understood that the technique is not intended to be limited to the particular forms disclosed. Rather, the technique is to cover all modifications, equivalents and alternatives falling within the spirit and scope of the technique as defined by the following appended claims.

What is claimed is:

1. A cable plug retention clip, comprising:

a clip body positionable about a power distribution unit configured to plug into a wall outlet and adapted to secure a cable plug to the power distribution unit, the clip body comprising:

a first retention mechanism adapted to secure the clip body to the power distribution unit in a substantially non-rotatable engagement; and a second retention mechanism comprising a tooth adapted to secure the clip body to the cable plug.

2. The cable plug retention clip of claim 1, wherein the first and second retention mechanisms are separated by a first distance substantially equal to a second distance between first and second mating retention structures of the power distribution unit and the cable plug, respectively.

3. The cable plug retention clip of claim 2, wherein the first retention mechanism comprises another tooth of the clip body below the tooth, and wherein the first and second mating retention structures comprise a slot of the power distribution unit and a lip of the cable plug, respectively.

4. The cable plug retention clip of claim 1, wherein the clip body comprises a U-shaped frame positionable about the power distribution unit.

5. The cable plug retention clip of claim 1, wherein the clip body comprises an L-shaped frame positionable about the power distribution unit.

6. The cable plug retention clip of claim 1, wherein the first retention mechanism comprises a projecting member engageable with a mating structure of the power distribution unit.

7. The cable plug retention clip of claim 1, wherein the second retention mechanism comprises a lug adapted to cooperate with a detent portion of the cable plug.

8. The cable plug retention clip of claim 1, comprising a retention wrap adapted to extend around the cable plug and the clip body to bias the second retention mechanism against the cable plug.

9. The cable plug retention clip of claim 1, wherein the clip body comprises a U-shaped frame that is integrally formed from a material with a generally rectangular cross-section.

10. The cable plug retention clip of claim 5, wherein the clip body comprises a base portion and a sidewall, and the first retention mechanism comprises the base portion, which is engageable with the power distribution unit on an opposite side from a receptacle for the cable plug.

11. A cable plug retention clip, comprising:

a clip body configured to secure a cable plug having a lip to a power strip, wherein the clip body is substantially peripheral to, and not electrically intermediate, the cable plug and the power strip, the clip body comprising:

a first retention mechanism comprising a first tooth configured to secure the clip body to the lip of the cable plug; and a second retention mechanism comprising a second tooth configured to non-rotatably secure the clip body to the power strip.

12. The cable plug retention clip of claim 11, wherein the second retention mechanism comprises a third tooth opposite the second tooth, and the second and third teeth are configured to engage slots on opposing sides in the power strip.

13. The cable plug retention clip of claim 11, wherein the clip body comprises a U-shaped frame having a base and a pair of resilient sides.

14. The cable plug retention clip of claim 11, wherein the clip body is positionable about at least two sides of the power strip.

15. The cable plug retention strip of claim 11, comprising a retention wrap configured to extend around the cable plug and the clip body to bias the first retention mechanism against the cable plug.

16. The cable plug retention clip of claim 11, wherein:

the clip body is positionable about the power strip;

the second retention mechanism comprises a third tooth opposite the second tooth, and the second and third teeth are configured to secure the clip body to slots on opposite sides of the power strip;

the first retention mechanism comprises a fourth tooth opposite the first tooth, and the first and fourth teeth are configured to secure the clip body to the lip of the cable plug; and the first and fourth teeth and the second and third teeth are separated by a first distance substantially equal to a second distance between the slot in the power strip and the lip of the cable plug.

17. The cable plug retention clip of claim 12, wherein the clip body comprises a U-shaped frame positionable about the power strip.

18. The cable plug retention clip of claim 17, wherein the second and third teeth are disposed on opposite portions of the U-shaped frame.

19. A cable plug retention clip, comprising:

a clip body comprising three sequential portions configured to contact at least three sides, including a backside, of a power distribution unit;

a first retention mechanism extending from the clip body and configured to secure a cable plug to the power distribution unit; and a second retention mechanism extending from the clip body and configured to secure the clip body to the power distribution unit, wherein:

the second retention mechanism comprises lower teeth configured to engage a slot in the power distribution unit;

the first retention mechanism comprises upper teeth configured to engage a lip of the cable plug; and the upper and lower teeth are separated by a first distance substantially equal to a second distance between the lip on the cable plug and the slot in the power distribution unit.

20. The cable plug retention clip of claim 19, wherein the clip body is a one-piece structure.

21. The cable plug retention clip of claim 19, wherein the three sequential portions of the clip body comprise a base and at least one side extending from the base to an end portion positionable at an offset away from the power distribution unit.

22. The cable plug retention clip of claim 19, wherein the second retention mechanism is configured to non-rotatably secure the clip body to the power distribution unit.

23. The cable plug retention clip of claim 20, wherein the first retention mechanism is a portion of the one-piece structure.

24. The cable plug retention clip of claim 23, wherein the second retention mechanism is a portion of the one-piece structure.

25. The cable plug retention clip of claim 19, wherein the clip body comprises a one-piece U-shaped frame including the first retention mechanism, and the one-piece U-shaped frame is resilient.

26. A cable plug retention clip, comprising:

a clip body comprising housing engagement portions configured to extend around and engage at least three sides of a circuitry housing;

a first retention mechanism comprising a distal end extending from the clip body and configured to secure the clip body to a cable plug, wherein the first retention mechanism and the clip body are a single piece of material; and a retention wrap configured to extend around the cable plug and the clip body and to bias the first retention mechanism against the cable plug.

27. The cable plug retention clip of claim 26, wherein the clip body comprises a second retention mechanism configured to secure the clip body to the circuitry housing.

28. The cable plug retention clip of claim 27, wherein the second retention mechanism comprises a tooth configured to engage the circuitry housing.

29. The cable plug retention clip of claim 27, wherein the clip body is a U-shaped frame.

30. The cable plug retention clip of claim 26, wherein the first retention mechanism comprises a tooth configured to engage a lip on the cable plug.

31. The cable plug retention clip of claim 30, wherein the second retention mechanism is configured to engage a slot in the circuitry housing.

32. The cable plug retention clip of claim 26, comprising a second retention mechanism including lower teeth configured to engage a slot in the power distribution unit, and wherein:

the first retention mechanism comprises upper teeth configured to engage a lip on the cable plug; and the upper and lower teeth are separated by a first distance substantially equal to a second distance between the slot in the power strip and the lip on the cable plug.

33. The cable plug retention clip of claim 26, wherein the clip body is independent of the circuitry housing.

* * * * *